US009251945B2

(12) United States Patent
Barthold

(10) Patent No.: US 9,251,945 B2
(45) Date of Patent: Feb. 2, 2016

(54) PLANAR CORE WITH HIGH MAGNETIC VOLUME UTILIZATION

(71) Applicant: Fred O. Barthold, Leucadia, CA (US)

(72) Inventor: Fred O. Barthold, Leucadia, CA (US)

( * ) Notice: Subject to any disclaimer, the term of this patent is extended or adjusted under 35 U.S.C. 154(b) by 0 days.

(21) Appl. No.: 14/247,000

(22) Filed: Apr. 7, 2014

(65) Prior Publication Data

US 2014/0340188 A1 Nov. 20, 2014

Related U.S. Application Data

(60) Provisional application No. 61/810,091, filed on Apr. 9, 2013.

(51) Int. Cl.

| | |
|---|---|
| ***H01F 27/24*** | (2006.01) |
| ***H01F 17/06*** | (2006.01) |
| ***H01F 27/28*** | (2006.01) |
| ***H01F 7/06*** | (2006.01) |
| ***H01F 41/02*** | (2006.01) |
| ***H01F 41/04*** | (2006.01) |

(52) U.S. Cl.

CPC ..... *H01F 27/24* (2013.01); *H01F 27/2804* (2013.01); *H01F 41/02* (2013.01); *H01F 41/041* (2013.01); *H01F 2027/2819* (2013.01); *Y10T 29/49073* (2015.01); *Y10T 29/49075* (2015.01)

(58) Field of Classification Search

CPC ..... H01F 3/14; H01F 17/0033; H01F 27/24; H01F 27/28; H01F 27/2804; H01F 41/041; H01F 41/02; H01F 27/26; H01F 2027/2819; Y10T 29/49075; Y10T 29/49073

USPC ..... 336/214, 212, 220, 221, 232, 178, 182, 336/184, 200; 29/606, 607

See application file for complete search history.

(56) References Cited

U.S. PATENT DOCUMENTS

| | | | | |
|---|---|---|---|---|
| 3,553,620 | A | 1/1980 | Cielo et al. | |
| 4,801,775 | A | 1/1989 | Cornell | |
| 4,965,712 | A * | 10/1990 | Duspiva et al. | 363/126 |
| 5,168,440 | A * | 12/1992 | Spreen | 363/126 |

(Continued)

FOREIGN PATENT DOCUMENTS

| | | |
|---|---|---|
| CN | 202487309 | 10/2012 |
| JP | 2001313222 | 11/2001 |
| WO | WO 2011/099976 A1 * | 8/2011 |
| WO | 2012001398 | 1/2012 |

OTHER PUBLICATIONS

E. E. Landsman, "A Unifying Derivation of Switching DC-DC Converter Topologies", PESC '79 Record, San Diego, Calif., Jun. 18-22, 1979, pp. 239-243.

(Continued)

*Primary Examiner* — Mangtin Lian

(74) *Attorney, Agent, or Firm* — Van Pelt, Yi & James LLP

(57) ABSTRACT

A structure is disclosed, comprising: a first magnetic core portion comprising: a first plurality of leg posts that are to be surrounded by a first set of windings; and a first plurality of center portions that are not to be surrounded by windings; and a second magnetic core portion comprising: a second plurality of leg posts that are to be surrounded by a second set of windings; and a second plurality of center portions that are not to be surrounded by the second set of windings, wherein the first set of center portions and the second set of center portions are configured to provide a plurality of physically separate magnetic flux paths.

18 Claims, 8 Drawing Sheets

(56) References Cited

U.S. PATENT DOCUMENTS

| | | | | |
|---|---|---|---|---|
| 5,436,818 | A | 7/1995 | Barthold | |
| 6,281,779 | B1 * | 8/2001 | Matsumoto et al. | 336/200 |
| 6,380,834 | B1 | 4/2002 | Canzano et al. | |
| 7,427,910 | B2 | 9/2008 | Mehrotra et al. | |
| 7,777,458 | B2 | 8/2010 | Barthold | |
| 7,812,577 | B2 | 10/2010 | Barthold | |
| 2002/0167388 | A1 * | 11/2002 | Usui | 336/200 |
| 2004/0145445 | A1 * | 7/2004 | Yang | 336/223 |
| 2006/0097837 | A1 * | 5/2006 | Yamasaki et al. | 336/208 |
| 2008/0024255 | A1 | 1/2008 | Sano | |
| 2009/0115564 | A1 | 5/2009 | Minteer | |
| 2011/0148563 | A1 * | 6/2011 | Tsai | 336/200 |
| 2012/0081202 | A1 * | 4/2012 | Nanayakkara et al. | 336/200 |
| 2012/0249280 | A1 | 10/2012 | Nussbaum | |

OTHER PUBLICATIONS

K. Yao et al., "Tapped-Inductor Buck Converters with a Lossless Clamp Circuit", APEC 2002 Proceedings, Dallas, Tex., Mar. 10-14, 2002, pp. 693-698.

P. Zumel, "Magnetic Integration for Interleaved Converters", APEC 2003 Proceedings, Miami Beach, Fla., Feb. 9-13, 2003, pp. 1143-1149.

R. A. Jensen and C. R. Sullivan, "Optimal Core Dimensional Ratios for Minimizing, Winding Loss in High-Frequency Gapped-Inductor Windings", APEC 2003 Proceedings, Miami Beach, Fla., Feb. 9-13, 2003, pp. 1164-1169.

J. Li et al., "Using Coupled Inductors to Enhance Transient Performance of Multi-Phase Buck Converters", APEC 2004 Proceedings, Anaheim, Calif., Feb. 22-26, 2004, pp. 1289-1293.

R. D. Middlebrook et al., "Advances in Switched-Mode Power Conversion", vols. I and II, 1983, pp. 205-218.

R. Lee, "Electronic Transformers and Circuits" (second edition), John Wiley & Sons, New York, N. Y., 1961, pp. 102 and 204.

R. Chen et al., "Integration of Electromagnetic Passive Components in DPS Front-End DC/DC Converter-A Comparative Study of Different Integration Steps", APEC 2003 Proceedings, Miami Beach, Fla., Feb. 9-13, 2003, pp. 1137-1142.

* cited by examiner

PLANAR CORE WITH HIGH MAGNETIC VOLUME UTILIZATION

CROSS REFERENCE TO OTHER APPLICATIONS

This application claims priority to U.S. Provisional Patent Application No. 61/810,091 entitled PLANAR CORE-TYPE UNIFORM EXTERNAL FIELD EQUALIZER AND A PLANAR CORE FOR MAXIMUM MAGNETIC VOLUME UTILIZATION filed Apr. 9, 2013 which is incorporated herein by reference for all purposes.

BACKGROUND OF THE INVENTION

The design and optimization efforts of electrical/electronic magnetic structures such as transformers often involve adjusting the dimensions of the magnetic core. Depending on the application, the requirements for dimensions and volume of the structure can differ. For example, a device that needs to handle 1 kW of power will be significantly greater in size than a device made of the same material but only needs to handle 1 W of power.

A commonly used design parameter is the $W_aA_c$ product, which determines the device's power-handling capability. $W_a$ is referred to as the window area, and $A_c$ is referred to as the core area. When designing a magnetic core, the designer typically starts with a specification of the $W_aA_c$ product and chooses a core structure that meets the specification. Many conventional core structures, however, are sub-optimal in terms of their magnetic volume utilization and can lead to excess core loss.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A planar-core type transformer with alternative core geometry is disclosed. In some embodiments, the transformer has a magnetic core structure comprising a first portion and a second portion. Each portion includes leg posts that are to be surrounded by a corresponding winding, and center portions that are not to be surrounded by windings. In some embodiments, parameters of the core portions are derived based on parameters of a transformer with a conventional three-legged core.

Figure 1:
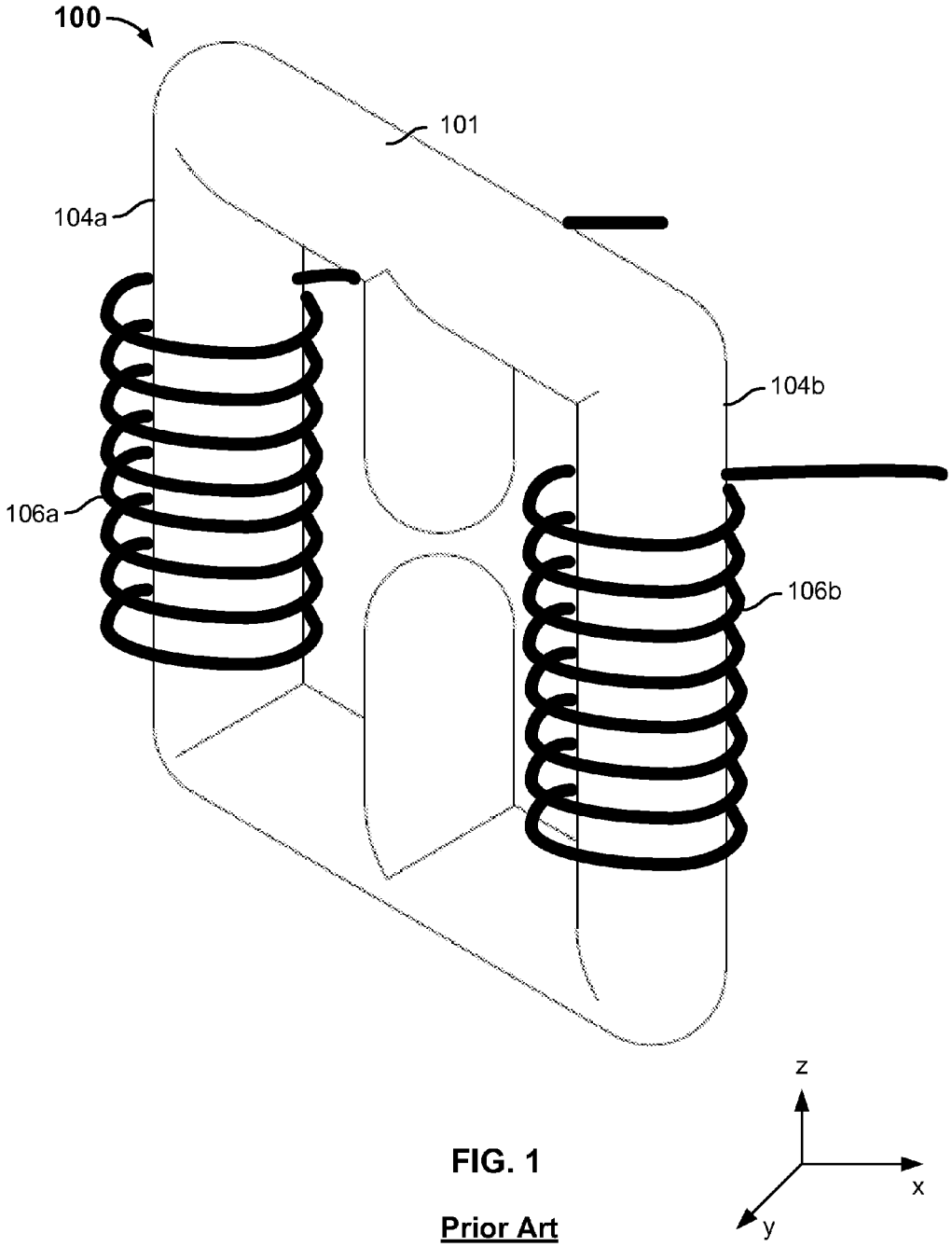
FIG. 1 Prior Art
FIG. 1 is a three-dimensional diagram illustrating an example of a transformer with a three-legged magnetic core structure.

FIG. 1 is a three-dimensional diagram illustrating an example of a transformer with a three-legged magnetic core structure. Transformer 100 includes two sets of windings 106*a* and 106*b* and a three-legged magnetic core 101. The windings are formed using conductive coils or wires, and surround two outer leg posts 104*a* and 104*b*.

Figure 2B:
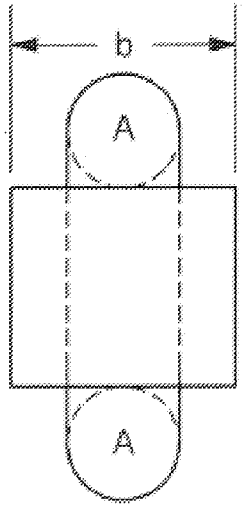
FIG. 2B Prior Art
FIGS. 2A-2C are projection views of an example transformer with a three-legged magnetic core structure, such as transformer 100 of FIG. 1.
Figure 2A:
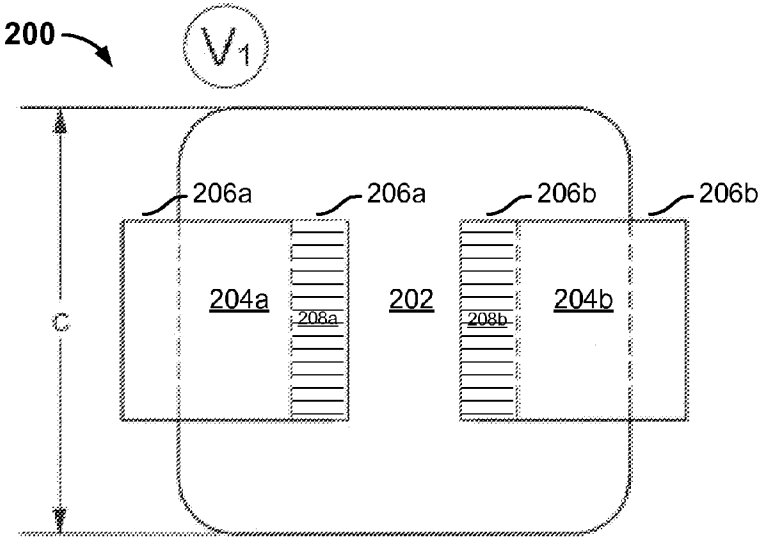
FIG. 2A Prior Art
Figure 2C:
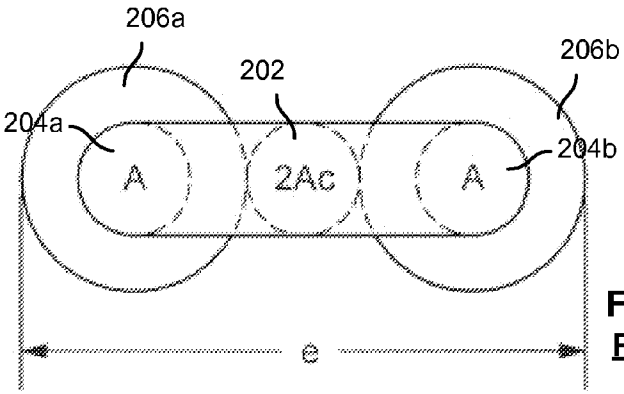
FIG. 2C Prior Art

FIGS. 2A-2C are projection views of an example transformer with a three-legged magnetic core structure, such as transformer 100 of FIG. 1.

FIG. 2A illustrates the front view of the example transformer along the y-axis. Magnetic core structure 200 includes a center leg post 202 and two outer leg posts 204*a* and 204*b*. The windings surrounding the outer leg posts are illustrated as 206*a* and 206*b*. Shaded areas 208*a* or 208*b* (areas between the center leg post and one of the outer leg posts) are each referred to as the window area, denoted as $W_a$. The number of turns in each winding and the cross sectional area of the wire used to construct the windings are constrained by the value of $W_a$ since the total cross sectional area of the windings cannot exceed this value. The height of the core structure is denoted as c.

FIG. 2B illustrates the side view of the example transformer along the x-axis. The top and bottom portions of the core have the same diameter as the outer leg posts to avoid loss due to flux density changes. The core has a cross sectional area of A. The width of the structure including the windings surrounding the core is denoted as b.

FIG. 2C illustrates the top view of the example transformer along the z-axis. Windings 206*a* surrounding outer leg post 204*a* and windings 206*b* surrounding outer leg post 204*b* are separated by center leg post 202. The center leg post's cross sectional area is denoted as $2A_c$. In this example, the center leg post has the same cross sectional area as each outer leg post. The length of the structure including the windings surrounding the core is denoted as e.

The volume of the device shown in FIGS. 2A-2C is the product of b, c, and e (bce).

In some planar applications where the windings of a transformer are embedded in a printed wiring board (PWB) (also referred to as a printed circuit board (PCB)), a conventional three-legged magnetic core geometry occupies a greater volume than necessary and can be unsuitable for certain designs with space constraints. The extra magnetic path length also leads to additional core loss. To reduce the volume of the transformer, a planar core-type transformer with a different core geometry is constructed while the area of the gapped magnetic path ($A_c$) and the window area parameter ($W_a$) are maintained. Specifically, a transformer with less volume is implemented using a core structure that redistributes the center area ($2A_c$) of the conventional three-legged core structure. Details of the structure and parameters of the transformer and its magnetic core are described below.

Figure 3:
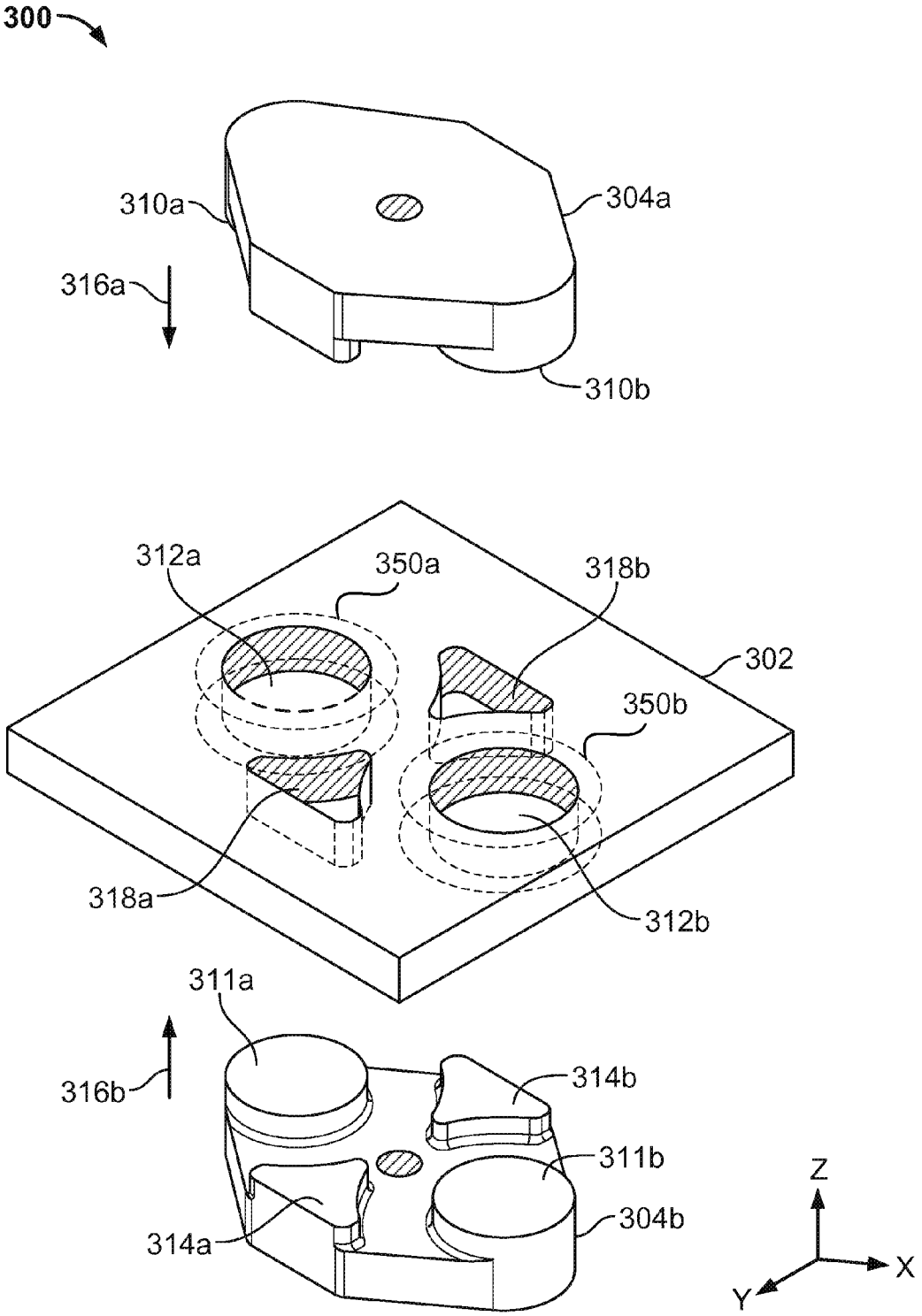
FIG. 3 is an exploded view of an embodiment of a planar core-type transformer.

FIG. 3 is an exploded view of an embodiment of a planar core-type transformer. In this example, transformer 300 includes a planar structure 302 that is formed in a printed wiring board (PWB), and a set of magnetic core halves 304*a* and 304*b* constructed using ferrite, silicon steel, or other appropriate magnetic material.

As shown, the magnetic core halves are identical structures. In a transformer assembly, the magnetic core halves are positioned to face each other. One side of the structure, 304*a*, is substantially flat. The other side of the structure, 304*b*, has circular protrusions 311*a* and 311*b*, and non-circular protrusions 314*a* and 314*b*.

Planar structure 302 includes a number of openings configured to receive two magnetic core halves 304*a* and 304*b*. Built into the PWB are a number of conductive layers (e.g., copper, alloy, etc.) separated by layers of insulating material (e.g., plastic, polymer, etc.). In this example, at least a portion of the conductive layers of the PWB forms the two sets of windings of the transformer in regions surrounding circular openings 312*a* and 312*b*. The windings 350*a* and 350*b* are embedded in the PWB using known techniques such as laminating or electroplating coils on individual layers and connecting the layers using vias. In some embodiments, the planar structure includes additional features such as equalizers formed using conductive plates and traces.

The transformer is assembled by placing the protrusions of magnetic core halves within the corresponding openings on the planar structure 302 and bringing the magnetic core halves together in the directions shown by arrows 316*a* and 316*b*, such that the surfaces of circular protrusions 310*a* and 311*a* are in contact, and the surfaces of circular protrusions 310*b* and 311*b* are in contact. Together, protrusions 310*a* and 311*a* join together to form one leg post of the core structure, and protrusions 310*b* and 311*b* join together to form another leg post. Since openings 312*a* and 312*b* are surrounded by the inductive windings formed in planar structure 302, when the core halves are brought together to form leg posts extending through the openings, the leg posts are also surrounded by the inductive windings.

Non-circular protrusions such as 314*a* and 314*b* (also referred to as the center portions) and their counterparts on core half 304 are placed through openings 318*a* and 318*b*, respectively. Since the non-circular protrusions are shorter than the circular protrusions, in the transformer assembly, the surfaces of the non-circular protrusions are not in contact and there is a gap between the non-circular protrusions. Further, the non-circular protrusions do not receive any inductive windings. In other words, since there are no windings surrounding openings 318*a* and 318*b*, there are no windings surrounding the non-circular protrusions. When a voltage is applied to the primary winding, magnetic flux is generated. Since the flux must form a complete loop, at least some of the magnetic flux generated by the inductive windings is redirected to return via the non-circular protrusions to complete a loop. In other words, the center portions provide physically separate paths for the magnetic flux. For example, assume that 8 units of magnetic flux are generated by a primary winding and crosses leg post 311*a*, half of which (4 units) are directed to leg post 311*b*. Accordingly, the remaining 4 units of magnetic flux are directed to center portions 314*a* and 314*b*. Because the center portions are constructed to be symmetrical, the flux is evenly divided, such that 2 units of the magnetic flux cross each of the center portions.

Figure 4A:
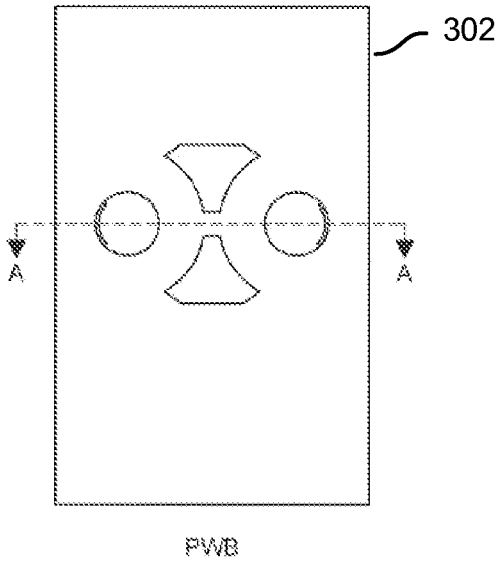
FIG. 4A is a top view of PWB structure 302 as shown in FIG. 3.

FIG. 4A is a top view of PWB structure 302 as shown in FIG. 3. The circular and non-circular openings are shown.

Figure 4B:
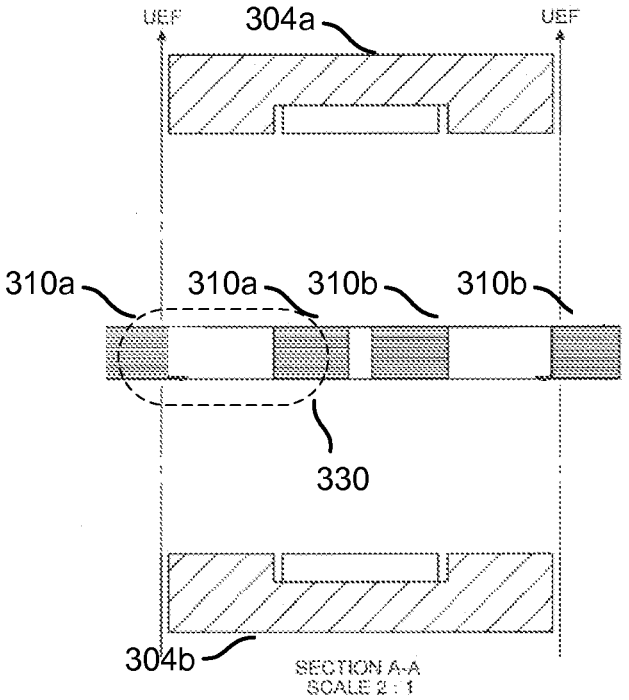
FIG. 4B is a cross sectional view of an example of an embodiment of a planar transformer comprising a uniform field equalizer.

FIG. 4B is a cross sectional view of an example of an embodiment of a planar transformer comprising a uniform field equalizer. In this example, a cross section along the line AA illustrated in FIG. 4A and perpendicular to the top and bottom surfaces of the PWB is shown. As shown, the PWB used to construct the transformer has a number of conductive layers comprising conductive material such as copper or alloy. The conductive layers are separated by insulating layers comprising non-conductive material such as plastic or polymer. The inductive coils can be formed using known techniques such as etching or electroplating a turn of the winding on each layer, and connecting the winding turns in different layers using vias to form the windings. The number of layers and PWB thickness depend on the requirements of the application and may vary in different embodiments. Cross sections of conductive layers 310*a*-310*b* are shown. Magnetic core halves 304*a* and 304*b* are also illustrated.

Figure 5A:
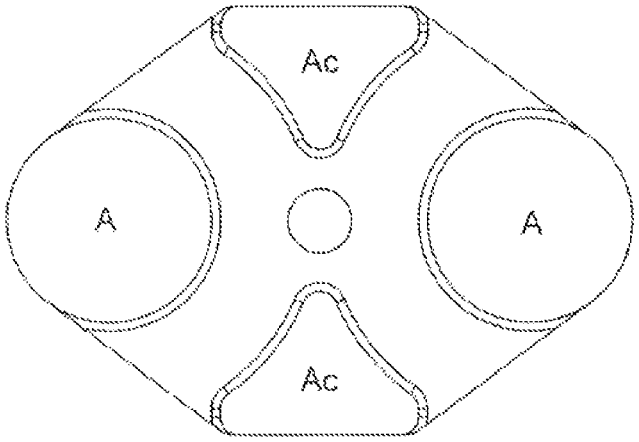
FIG. 5A is a top view of an embodiment of a core half structure such as 304*a* or 304*b*.
Figure 5B:
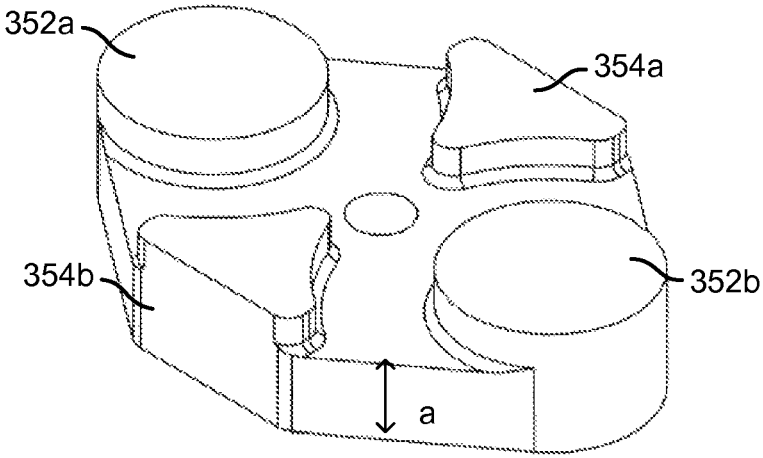
FIG. 5B is a three dimensional view of an embodiment of a core half structure such as 304*a* or 304*b*.
Figure 5C:
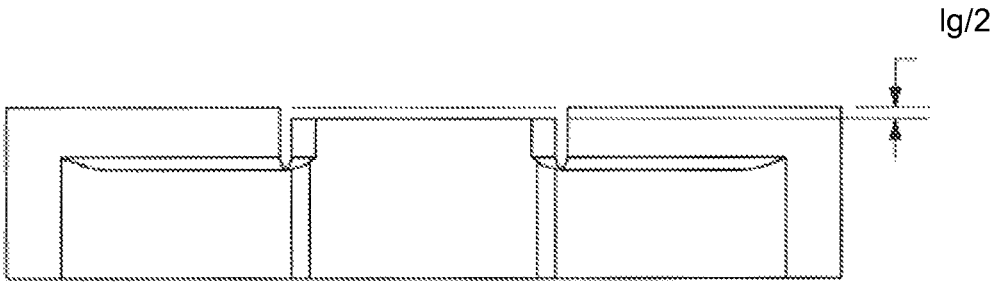
FIG. 5C is a side view of an embodiment of a core half structure such as 304*a* or 304*b*.

FIG. 5A is a top view of an embodiment of a core half structure such as 304*a* or 304*b*. FIG. 5B is a three dimensional view of an embodiment of a core half structure such as 304*a* or 304*b*. In some embodiments, the core half structure is constructed using ferrite material. Outer leg protrusions 352*a* and 352*b* are taller than center protrusions 354*a* and 354*b* so that when two magnetic core halves are brought together in the transformer assembly, a gap is formed between the center protrusions. The structure may be formed by machining, casting, molding (including injection molding), or any other appropriate techniques. FIG. 5C is a side view of an embodiment of a core half structure such as 304*a* or 304*b*. The height difference of protrusions 354*a* (or 354*b*) and protrusions 352*a* (or 352*b*) is one half of the total gap distance of the transformer (represented as lg/2).

Figure 6B:
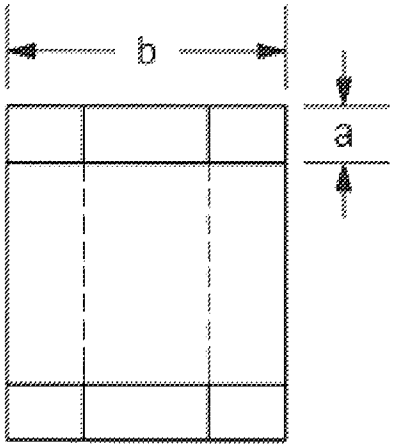
FIGS. 6A-6C are projection views of an embodiment of a planar-core type transformer such as 300 of FIG. 3.
Figure 6A:
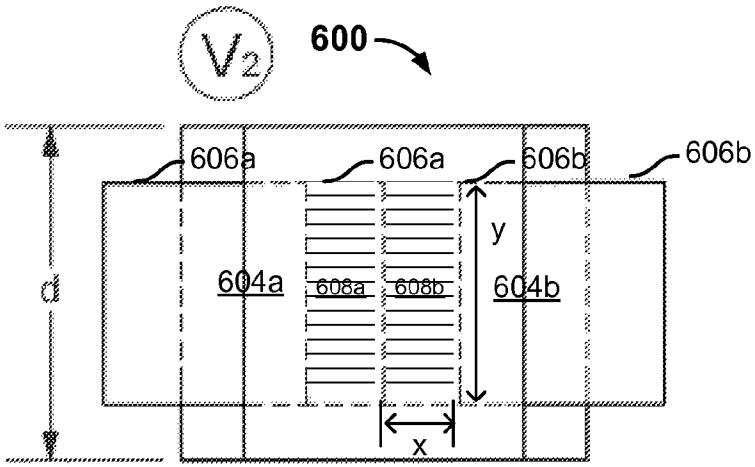
Figure 6C:
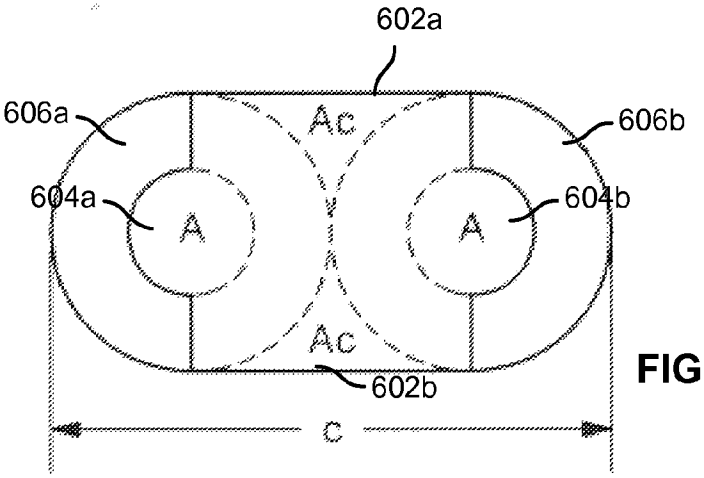

FIGS. 6A-6C are projection views of an embodiment of a planar-core type transformer such as 300 of FIG. 3.

FIG. 6A illustrates the front view of the transformer embodiment along the y-axis. Magnetic core structure 600 includes two leg posts 604*a* and 604*b*. The windings surrounding the leg posts are illustrated as 606*a* and 606*b*. Shaded areas 608*a* and 608*b* (the areas between a leg post and the center of the core structure) are each referred to as the window area. This window area is maintained to be $W_a$, which is the same as the window area of structure 200 of FIG. 2A. The height of the core structure is denoted as d. In this case, the height of core 600 is represented as d.

FIG. 6B illustrates the side view of the transformer embodiment along the x-axis. The width of the structure is denoted as b, the thickness of the core plate is represented as a. The cross sectional area of the core plate (ab) is maintained to be the same as the cross sectional area A of FIG. 2B.

FIG. 6C illustrates the top view of the transformer embodiment along the z-axis. Windings 606*a* surrounding leg post 604*a* is adjacent to windings 606*b* surrounding leg post 604*b* without being separated by a center leg as the structure shown in FIG. 2C. The cross sectional area of each leg post is denoted as A. Compared with FIG. 2C, the cross sectional area of center leg post 202 is distributed to two center portions 602*a* and 602*b*, each having a cross sectional area of $A_c$.

The volume of the transformer embodiment shown in FIGS. 6A-6C is computed as bcd.

The relationships of the parameters (dimensions, volumes, and areas) of the structure shown in FIGS. 2A-2C and the structure shown in FIGS. 6A-6C are as follows:

$$W_a = \frac{8A}{\pi} \tag{1}$$

where $W_a$ is the window area, A corresponds to the cross sectional area of a leg post.

$$A=2A_c=ab \tag{2}$$

where $A_c$ corresponds to the core area in both figures, a corresponds to the thickness of the core base (as shown in FIG. 5B), and b corresponds to the core width of both FIG. 2B and FIG. 6B.

$$b = 4\sqrt{A/\pi} = 4\sqrt{2A_c/\pi} \tag{3}$$

$$a = \frac{A}{b} = \frac{2A_c}{b} \tag{4}$$

$$c = 8\sqrt{\frac{A}{\pi}} = 8\sqrt{\frac{2A_c}{\pi}} \tag{5}$$

where c corresponds to the core length of FIG. 6C and the core height of FIG. 2A.

$$e = 10\sqrt{\frac{A}{\pi}} \tag{6}$$

where e corresponds to the core length of FIG. 2C.

$$d = 5.6\sqrt{\frac{A}{\pi}} = 5.6\sqrt{\frac{2A_c}{\pi}} \tag{7}$$

where d corresponds to the core height of FIG. 6A.

$$V_1 = bce = 230\frac{A}{\pi}\sqrt{\frac{A}{\pi}} \tag{8}$$

where $V_1$ corresponds to the volume of the core structure of FIGS. 2A-2C.

$$V_2 = bcd = 179.2\frac{A}{\pi}\sqrt{\frac{A}{\pi}} \tag{9}$$

where V2 corresponds to the volume of the core structure of FIGS. 6A-6C.

$$\frac{V_2}{V_1} = 0.56 \tag{10}$$

As can be seen, the transformer design of FIG. 3 maintains the same window area ($W_a$) and the core cross section ($A_c$) as FIG. 2A while reducing the volume substantially. In addition, the total length of the magnetic path is reduced, leading to enhancements in open circuit inductance (OCL) and effective permeability ($\mu_e$).

To design a magnetic core structure used in a planar-core type transformer such as 300, a $W_aA_c$ product is specified based on requirements of the application, using known techniques. For example, in some embodiments, the product is specified according to:

$$W_aA_c = \frac{P_oD_{cma}}{K_tB_{maxf}} \tag{11}$$

where $P_o$ corresponds to power out, $D_{cma}$ corresponds to current density, $B_{max}$ corresponds to flux density, $K_t$ is a constant based on the type of topology, and f corresponds to the frequency.

The window area ($W_a$) is then determined. In some embodiments, the determination is based at least in part on the thickness and the width of the windings and the number of turns in a winding. Referring to FIG. 6A for an example, the width of the winding coils corresponds to x; the thickness of each layer in the PWB multiplied by the number of turns in the winding corresponds to y. Accordingly, $$W_a=x*y \tag{12}$$

The value of core area $A_c$ is then determined based on $W_aA_c$ and $W_a$, and dimensions a, b, c, and d are determined according to equations (3)-(7) to specify a structure similar to what is shown in FIG. 3 and FIGS. 6A-6C.

Figure 7:
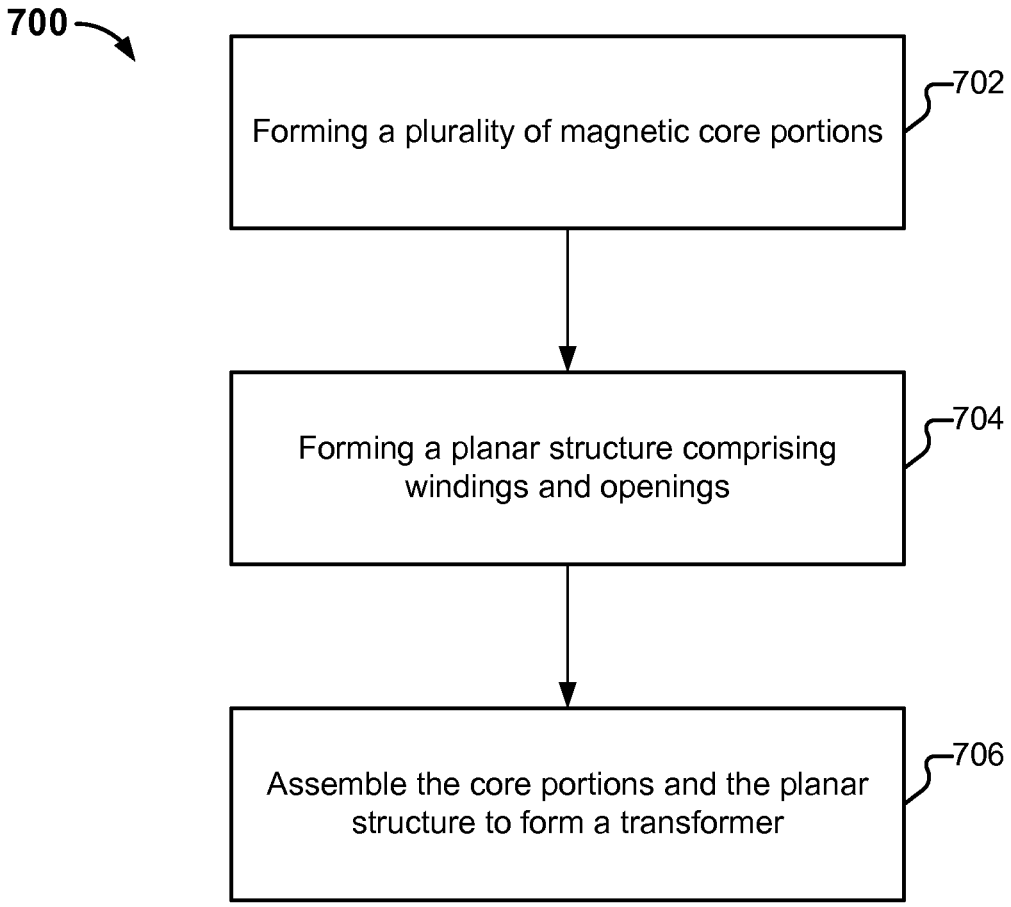
FIG. 7 is a flowchart illustrating an embodiment of a process (700) for constructing a device with a modified magnetic core.

FIG. 7 is a flowchart illustrating an embodiment of a process for constructing a device with a modified magnetic core.

Process 700 starts at 702, where a plurality of magnetic core portions (e.g., two core halves), each having leg posts to be surrounded by sets of windings and center posts that are not to be surrounded by the windings, are formed. In various embodiments, the magnetic core portions are formed using techniques such as machining, casting, molding (including injection molding), or any other appropriate techniques.

At 704, a planar structure comprising the windings and openings to receive the leg posts and center posts of two magnetic core halves is formed. In some embodiments, the planar structure is formed on a PWB. The windings can be formed by etching, electroplating, or other appropriate techniques on individual layers, laminated, and connected using vias as described below in connection with FIG. 8. The openings can be made by drilling on the laminated PWB.

At 706, the core portions and the planar structure are assembled to form a transformer. Specifically, the core portions are placed within the openings of the planar structure so that the leg posts extend through their corresponding openings to be surrounded by the windings, and the center posts extend through their corresponding openings.

Figure 8:
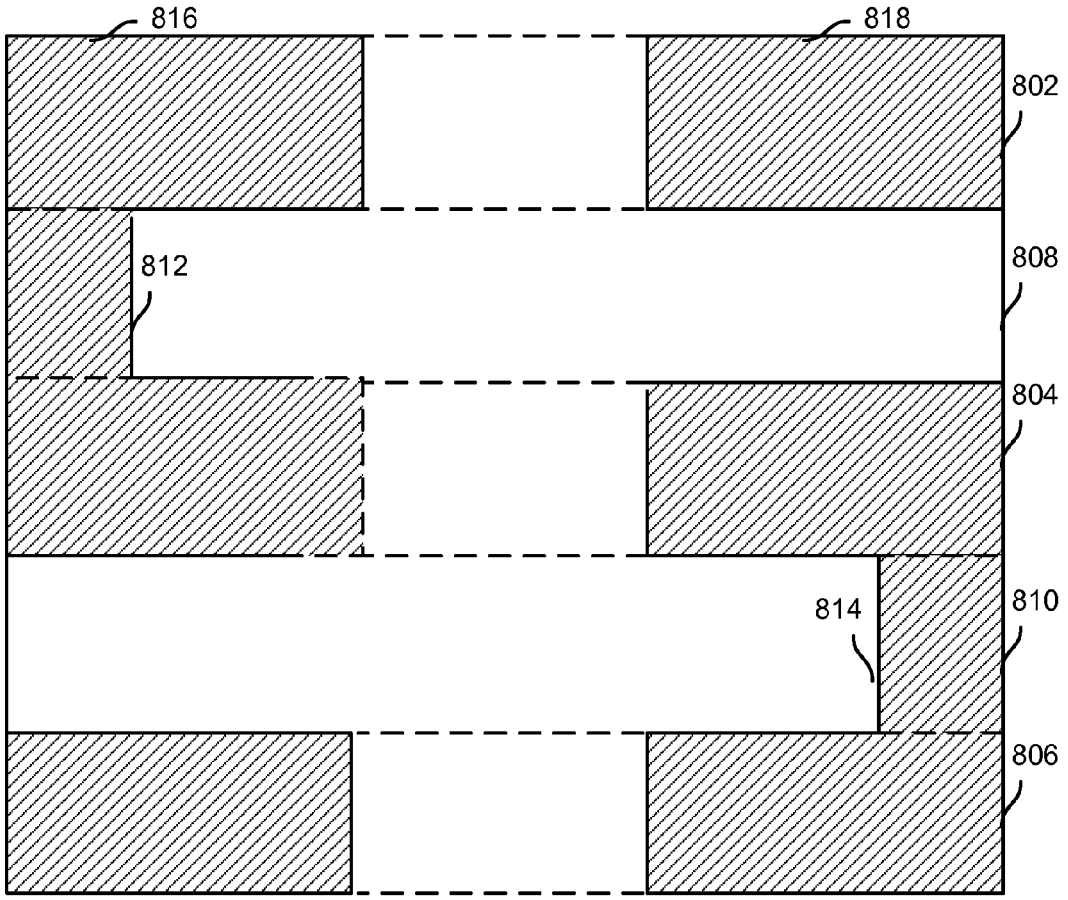
FIG. 8 is a diagram illustrating an enlarged cross sectional view that corresponds to region 330 shown in FIG. 4B.

FIG. 8 is a diagram illustrating an enlarged cross sectional view that corresponds to region 330 shown in FIG. 4B.

Only three conductive layers 802, 804, and 806 are shown for purposes of illustration, although additional layers are used in the circuit. Within the same layer, conductive portions such as 816 and 818 are electrically connected. The conductive layers are separated by insulating layers 808 and 810. To connect two adjacent conductive layers, vias such as 812 and 814 are formed by drilling openings in the insulating layers and filling the openings with conductive material (e.g., copper or other metal). In various embodiments, the size and locations of the vias may differ.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A structure comprising:

a first magnetic core portion comprising:

a first plurality of leg protrusions comprising a first protrusion that is to be surrounded by at least a first portion of a first winding, and a second protrusion that is to be surrounded by at least a first portion of a second winding; and a first plurality of center portions that are not to be surrounded by any windings; and a second magnetic core portion comprising:

a second plurality of leg protrusions comprising a third protrusion that is to be surrounded by at least a second portion of the first winding, and a fourth protrusion that is to be surrounded by at least a second portion of the second winding; and a second plurality of center portions that are not to be surrounded by any windings; wherein the first plurality of leg protrusions is different from the second plurality of leg protrusions;

the first plurality of center portions and the second plurality of center portions are configured to provide a plurality of physically separate magnetic flux paths;

a center portion among the first plurality of center portions is shorter than the first protrusion or the second protrusion; and a center portion among the second plurality of center portions is shorter than the third protrusion or the fourth protrusion.

2. The structure of claim 1, further comprising the first winding and the second winding.

3. The structure of claim 1, further comprising the first winding and the second winding, wherein the first winding and the second winding are both formed within a printed wiring board (PWB).

4. The structure of claim 1, further comprising the first winding and the second winding, wherein the first winding is adjacent to the second winding.

5. The structure of claim 1, wherein:

the center portions and the leg portions have different cross sectional shapes; and the first plurality of center portions and the second plurality of center portions have non-circular cross sections.

6. The structure of claim 1, further comprising the first winding and the second winding, wherein the first magnetic core portion, the second magnetic core portion, and a planar structure comprising the first winding and the second winding are assembled to form a transformer.

7. The structure of claim 1, wherein:

the structure has a specified $W_aA_c$ product, wherein $W_a$ is a window area;

a center portion of the first plurality of center portions has a cross sectional area of size $A_c$; and a center portion of the second plurality of center portions has a cross sectional area of size $A_c$.

8. The structure of claim 7, wherein:

a leg post of the first plurality of leg protrusions has a cross sectional area of size $2A_c$; and a leg post of the second plurality of leg protrusions also has a cross sectional area of size $2A_c$.

9. The structure of claim 1, wherein each center portion is situated in a region between two leg protrusions.

10. A method comprising:

forming a first magnetic core portion, including to form:

a first plurality of leg protrusions comprising a first protrusion that is to be surrounded by at least a first portion of a first winding, and a second protrusion that is to be surrounded by at least a first portion of a second winding; and a first plurality of center portions that are not to be surrounded by any windings; and forming a second magnetic core portion, including to form:

a second plurality of leg protrusions comprising a third protrusion that is to be surrounded by at least a second portion of the first winding, and a fourth protrusion that is to be surrounded by at least a second portion of the second winding; and a second plurality of center portions that are not to be surrounded by any windings; wherein:

the first plurality of center portions and the second plurality of center portions are configured to provide a plurality of physically separate magnetic flux paths;

a center portion among the first plurality of center portions is formed to be shorter than the first protrusion or the second protrusion; and a center portion among the second plurality of center portions is formed to be shorter than the third protrusion or the fourth protrusion.

11. The method of claim 10, further comprising forming the first winding and the second winding.

12. The method of claim 10, further comprising forming the first winding and the second winding within a printed wiring board (PWB).

13. The method of claim 10, further comprising forming the first winding to be adjacent to the second winding within a printed wiring board (PWB).

14. The method of claim 10, wherein:

the center portions and the leg portions are formed to have different cross sectional shapes; and the first plurality of center portions and the second plurality of center portions are formed to have non-circular cross sections.

15. The method of claim 10, further comprising assembling the first magnetic core portion, the second magnetic core portion, and a planar structure comprising the first winding and the second winding to form a transformer.

16. The method of claim 15, wherein:

the transformer is formed to have a specified $W_aA_c$ product, $W_a$ being a window area;

a center portion of the first plurality of center portions is formed to have a cross sectional area of size $A_c$; and a center portion of the second plurality of center portions is formed to have a cross sectional area of size $A_c$.

17. The method of claim 16, wherein:

a leg post of the first plurality of leg protrusions is formed to have a cross sectional area of size $2A_c$; and a leg post of the second plurality of leg protrusions is formed to also have a cross sectional area of size $2A_c$.

18. The method of claim 10, wherein each center portion is formed to be situated in a region between two leg protrusions.

* * * * *